United States Patent [19]

Yunan

[11] 4,424,747

[45] Jan. 10, 1984

[54] NON-ELECTRIC BLASTING ASSEMBLY

[75] Inventor: Malak E. Yunan, Boonton Township, Morris County, N.J.

[73] Assignee: E. I. Du Pont de Nemours and Company, Wilmington, Del.

[21] Appl. No.: 257,973

[22] Filed: Apr. 27, 1981

[51] Int. Cl.[3] ..... C06C 5/00

[52] U.S. Cl. ..... 102/275.2; 102/275.3; 102/275.4; 102/275.7

[58] Field of Search ..... 102/275.4, 275.3, 275.2, 102/275.7, 275.8

[56] References Cited

U.S. PATENT DOCUMENTS

| | | | |
|---|---|---|---|
| 3,306,201 | 2/1967 | Noddin | 102/275.3 |
| 3,349,706 | 10/1967 | Schaumann | 102/275.7 |
| 3,709,149 | 1/1973 | Driscoll | 102/312 |
| 3,713,384 | 1/1973 | Turnbull | 102/275.7 X |
| 4,024,817 | 5/1977 | Calder et al. | 102/275.7 X |
| 4,232,606 | 11/1980 | Yunan | 102/275.8 |
| 4,248,152 | 2/1981 | Yunan | 102/275.4 |
| 4,335,652 | 6/1982 | Bryan | 102/275.3 X |

OTHER PUBLICATIONS

Co-pending U.S. Patent Application Ser. No. 144,535, filed Apr. 28, 1980.

E. I. Du Pont de Nemours & Co., *Blasters' Handbook,* 175th Anniversary Edition, 1977, pp. 104 and 132.

*Primary Examiner*—David H. Brown

*Attorney, Agent, or Firm*—Diamond C. Ascani

[57] ABSTRACT

A percussion-actuated instantaneous or delay detonator transmits a detonation from a first length of low-energy detonating cord (LEDC) transversely positioned adjacent the detonator's percussion-responsive end to a U-shaped segment of a second length of LEDC held with its apex against the base-charge end of the detonator and the arms of the U extending away from the detonator. A directional connector for connecting one or more U-shaped segments of detonating cord adjacent each end of the detonator has identifiable donor- and receiver-cord-housing sections, e.g., the receiver-cord-housing section has the shape of the head, and the donor-cord-housing section the shape of the butt, of an arrow. A connector adapted to hold receiver LEDC and high-energy detonating cord (HEDC) segments is internally configured to receive nested U-shaped segments of LEDC and HEDC only when the LEDC is adjacent the base-charge end of the detonator.

29 Claims, 5 Drawing Figures

NON-ELECTRIC BLASTING ASSEMBLY

BACKGROUND OF THE INVENTION

1. Field of the Invention

The present invention relates to an assembly of donor and receiver detonating cords and a detonation-transmitting device which joins said cords in detonation-propagating relationship, and to a connector for holding donor and receiver detonating cords in detonation-propagating relationship to the input and output ends of a detonator.

2. Description of the Prior Art

Detonating cords are used in non-electric blasting systems to convey or conduct a detonation wave to an explosive charge in a borehole from a remote area. One type of detonating cord, known as low-energy detonating cord (LEDC), has an explosive core loading of only about 0.1 to 2 grams per meter of cord length. Such a cord is characterized by low brisance and the production of little noise, and therefore is particularly suited for use as a trunkline in cases where noise has to be kept to a minimum, and as a downline for the bottom-hole priming of an explosive charge.

In blasting practice, detonating cords must be joined together, e.g., in the joining of downlines to a trunkline, and the explosion must be transmitted from one cord to another. Depending on its structure and composition, a low-energy receiver cord may or may not be able to "pick-up", i.e., to detonate, from the detonation of a donor cord with which it is spliced or knotted. If the receiver cord is unable to pick up from the detonation of the donor cord, a booster or starter such as that described in U.S. Pat. No. 4,248,152 can be introduced between the cords. This particular booster contains a granular explosive charge, e.g., PETN, between the walls and closed bottoms of inner and outer shells, one cord being held in an axial cavity in the inner shell in a manner such that an end-portion of the cord is surrounded by the booster explosive, and another cord being positioned transversely outside and adjacent to the closed end of the outer shell. One of the cords (donor) initiates the booster explosive and this in turn initiates the other cord (receiver), which usually is LEDC. The axial cord has its end, i.e., its explosive core, near, and preferably in contact with, the inner shell adjacent to the booster explosive charge, a cord-gripping means being required to hold the axial cord in this position. Thus, this booster transmits a detonation to the end of a detonating cord from the side of a detonating cord, or vice versa, and is especially suited for trunkline/downline connections.

In the art of delay blasting, a delay unit or device is inserted between two lengths of a detonating cord trunkline, or between a trunkline and downline to cause a surface delay of the detonation of an explosive charge in a borehole. A connector for securing a high-energy detonating cord (HEDC) such as Primacord ® to each end of a delay device is described in U.S. Pat. No. 3,349,706. This connector is adapted to hold a U-shaped segment of the cord adjacent to each end of the tubular shell of a delay unit located in the bore of a central tubular portion whereby the side-output of one cord segment initiates the delay unit, and the latter in turn initiates the other cord segment through its side wall.

Certain low-energy detonating cords, especially the cord described in U.S. Pat. No. 4,232,606, are known to be difficult to initiate by means of a detonator if the detonator-to-cord abutment is not coaxial, and although the booster described in the aforementioned U.S. Pat. No. 4,248,152 is capable of initiating said cord through the cord side wall, the initiation of a cord of this type by a detonator having its base-charge end butted against the side wall of the cord has not been reported. For example, of the delay connectors described in U.S. Pat. No. 3,306,201, the one which is designed to be side-actuated by, and to side-initiate, a detonating cord, requires a high-energy detonating cord, e.g., one having an explosive loading of 16 grams per meter. LEDC donor and receptor cords are positioned coaxial to the delay device in the connector, i.e., with the cord ends abutting the delay device. Co-pending U.S. patent application Ser. No. 144,535, filed Apr. 28, 1980, now U.S. Pat. No. 4,299,167, describes an initiator for introducing a delay between two lengths of LEDC trunkline or an LEDC trunkline and LEDC downline. Although this surface delay initiator is actuated from the side output of the dónor cord, the receiver cord which it initiates is end-initiated, i.e., the receiver cord coaxially abuts the initiator. Coaxial positioning of a cord may be a disadvantage because the cord has to be cut to provide the required abutting end surface, i.e., cord continuity is lost.

U.S. Pat. No. 3,709,149 describes a delay detonator which is initiated by a low-energy detonating cord positioned laterally adjacent an ignition capsule in the detonator. However, this detonator generally is positioned in a booster unit embedded in an explosive charge in the borehole. When used at the surface to connect a trunkline to one or more downlines, the downlines abut the side of the detonator shell at the base charge end.

SUMMARY OF THE INVENTION

The present invention provides a non-electric blasting assembly of donor and receiver low-energy detonating cords joined in detonation-propagating relationship by a detonation-transmitting device, said assembly comprising:

(a) first and second lengths of low-energy detonating cord having an explosive core loading of about from 0.2 to 2 grams per meter of length;

(b) a percussion-actuated detonator comprising a tubular metal detonator shell integrally closed at an output end and closed at its other, input end by a partially empty, shorter tubular metal primer shell having an open end and supporting a percussion-sensitive primer charge adjacent the inside surface of an integrally closed end, said primer shell, e.g., an empty primed rifle cartridge casing, for example for 0.22 caliber short ammunition, extending open end first into said detonator shell to dispose the outside surface of its primer charge end adjacent, and across, the end of said detonator shell, said detonator shell containing, in sequence from its integrally closed end, (1) a base charge of a detonating explosive composition, (2) a priming charge of a heat-sensitive detonating explosive composition, and, optionally, (3) a delay charge of an exothermic-burning composition;

(c) means for holding said first length of cord, i.e., the donor cord, with a portion of its side adjacent, and preferably in contact with, the outside end surface of said primer shell and for holding the apex of a substantially U-shaped segment of said second length of cord, i.e., the receiver cord, adjacent, and preferably in contact with, the integrally closed end of said detonator shell in a manner such that the two arms of the U extend away from said detonator in a direction substantially parallel to the longitudinal axis of said detonator shell; and (d) means on said holding means for identifying the input and output ends of the detonator held thereby.

The holding means may hold additional segments of cord adjacent the ends of the detonator, as will be explained more fully hereinafter.

In a preferred assembly, the segments of both the donor and receiver cords adjacent the input and output ends of the detonator, respectively, are substantially U-shaped. In another preferred assembly of the invention, there are two receiver cords, i.e., (a) a length of LEDC which is adjacent, and preferably in contact with, the output end of the detonator, and (b) a length of HEDC, a substantially U-shaped segment of which is nested within the arms of the substantially U-shaped LEDC segment, these two U-shaped segments of receiver cords preferably being held in side-by-side, apex-to-apex contact, with all four arms of the U's in the two segments lying in substantially the same plane as the longitudinal axis of the bore in the central tubular portion.

This invention also provides a directional connector for holding donor and receiver detonating cords in detonation-propagating relationship to the input and output ends of a detonator, which connector comprises:

(a) a central tubular portion whose bore is adapted to receive a detonator having a percussion-responsive input end and a base-charge output end;

(b) a cord-housing section at each end of the tubular portion and communicating with the bore thereof, one such section being identifiable as a donor-cord-housing section and the other as a receiver-cord-housing section, each such section being adapted to house a substantially U-shaped segment, or pair of juxtaposed substantially U-shaped segments, of LEDC with the two arms of each U lying in a plane which is parallel to, or substantially coincident with, a plane containing the longitudinal axis of the bore, and the apex of one or two U's positioned adjacent each end of the bore, the cord housing sections having a pair of matched oppositely disposed apertures on an axis which is substantially perpendicular to said planes, and being identifiable as donor-cord-housing and receiver-cord-housing sections for identifying the input and output ends of the detonator which the bore is adapted to receive, the input end of the detonator being the end located adjacent the donor-cord-housing section and the output end being the end located adjacent the receiver-cord-housing section; and (c) two tapered pins, one mateable with each pair of apertures and adapted to extend through the apertures and between the arms of the U-shaped segment(s) of cord, and to hold the apex of the U('s) adjacent the end of the detonator. Each tapered pin is attached to the cord-housing section with which it cooperates by a thin flexible web of plastic so that the pins remain attached when the apertures are open to allow insertion of the U-shaped cord segment(s) into the cord-housing section, after which the pins are inserted into the apertures between the arms of the U-shaped cord segments.

In a preferred directional connector, the receiver-cord-housing section has the shape of the head, and the donor-cord-housing section the shape of the butt, of an arrow.

Also provided by the invention is a connector which comprises:

(a) a central tubular portion whose bore is adapted to receive a detonator having a percussion-responsive input end and a base-charge output end;

(b) first and second cord-housing sections at the ends of the tubular portion and communicating with the bore thereof, the first section being adapted to house a substantially U-shaped segment, or pair of juxtaposed or nested substantially U-shaped segments, of donor LEDC with the two arms of each U lying in a plane which is parallel to, or substantially coincident with, a plane containing the longitudinal axis of the bore, and the apex of one or two U's positioned adjacent the end of the bore, and the second section being adapted to house a substantially U-shaped segment of receiver LEDC or HEDC, or pair of juxtaposed segments of receiver LEDC, optionally with one or more substantially U-shaped segments of LEDC and/or HEDC nested within the arms of said receiver segment(s), with the two arms of each U lying in a plane which is parallel to, or substantially coincident with, a plane containing the longitudinal axis of the bore, and the apex of at least one U being positioned adjacent the end of the bore, the first and second cord-housing sections each having a pair of matching oppositely disposed apertures on an axis which is substantially perpendicular to said planes; and (c) two tapered pins, one mateable with each pair of apertures and adapted to extend through the apertures and between the arms of the substantially U-shaped segment(s) of cord, and to hold the apex of the U('s) adjacent the end of the detonator, the apex of one or both of the substantially U-shaped segments of donor LEDC adapted to be housed in the first cord-housing section being adapted to be held adjacent, and preferably in contact with, the input end of the detonator, and the apex of one or two of the substantially U-shaped segments of receiver detonating cord(s) adapted to be housed in the second cord-housing section being adapted to be held adjacent the output end of the detonator, the internal surface of the second cord-housing section, and/or the internal surface of the end of the central tubular portion adjacent thereto, being so configured that when the second cord-housing section is adapted to house two or more segments of LEDC and HEDC, only LEDC segment(s) are adapted to be held adjacent the output end of the detonator.

The LEDC/detonator assembly of this invention is made by joining the cords, detonator, and connector together at the blasting site. In one embodiment, the donor cord is a trunkline and the receiver cord a downline, and the detonator is an instantaneous or delay starter for the downline. In another embodiment, both cords are segments of a trunkline, and the detonator is a surface delay or instantaneous detonator. In a still further embodiment, a high-energy cord such as Primacord ® adjacent the LEDC receiver is a downline.

BRIEF DESCRIPTION OF THE DRAWING

In the accompanying drawing, which illustrates specific embodiments of the LEDC/detonator assembly and connector of the invention.

DETAILED DESCRIPTION

Figure 1:
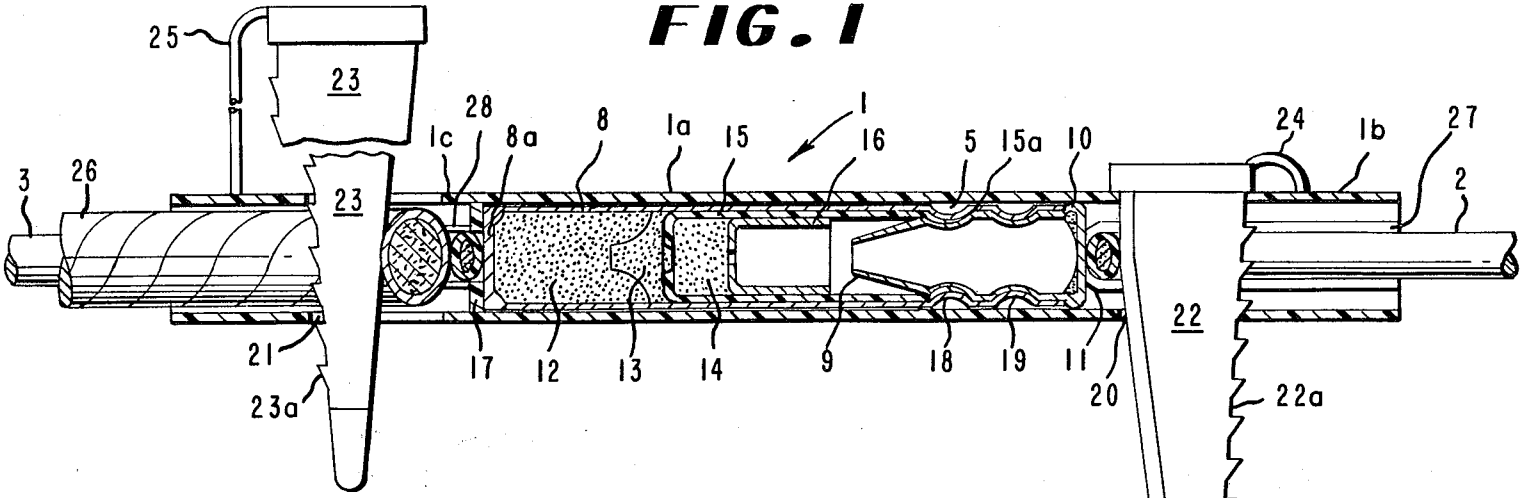
FIG. 1 is a cross-sectional view of a preferred assembly and connector, showing substantially U-shaped segments of an LEDC donor cord and of a pair of receiver cords held in propagating relationship with respect to a detonator in a directional connector of the invention, the cross-section being in a plane substantially normal to the plane in which the cords lie.
Figure 2:
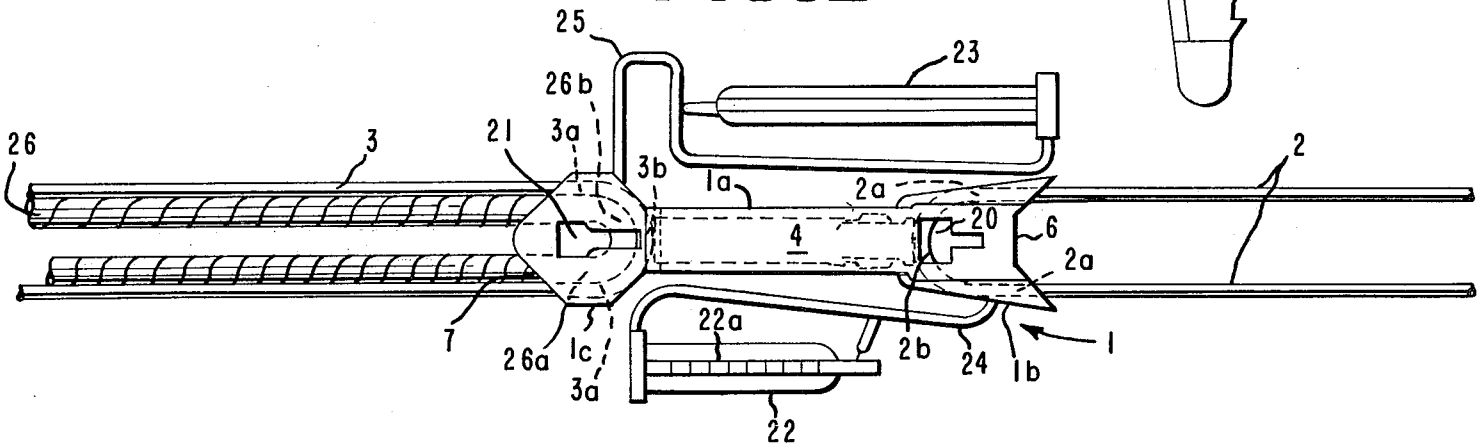
FIG. 2 is a plan view of the assembly of FIG. 1.

Referring to FIGS. 1 and 2, 1 is a connector for holding first and second lengths of LEDC 2 and 3 in contact with the ends of a detonator 4. Connector 1 is a hollow body, typically one-piece and made of thermoplastic material, having a central tubular portion 1*a* with an axial bore 5 which communicates at each of its ends with the hollow interiors of cord-receiving sections 1*b* and 1*c*. Sections 1*b* and 1*c* are flat, hollow bodies that are somewhat similar in configuration except at their free open ends 6 and 7, respectively. This configuration is generally that of a semi-elliptic arch (paraboloid) having a major axis that is coaxial with the longitudinal axis of bore 5. The minor axis of the paraboloid is the major axis of its cross-sectional ellipse, and its height (or the thickness of the flat body) is the minor axis of the cross-sectional ellipse. The diameter of bore 5 is such that it peripherally engages detonator 4, a snug force fit being preferred. The height of section 1*b* along the major axis of the paraboloid is sufficient to facilitate insertion of detonator 4 into bore 5.

Ends 6 and 7 of sections 1*b* and 1*c*, respectively, are so configured that they constitute means for identifying the input and output ends of the detonator held in bore 5. Together with tubular portion 1*a*, sections 1*b* and 1*c* form a hollow arrow, with section 1*c* having the shape of the head, and section 1*b* the butt, of the arrow. With this configuration as a guide, detonator 4 is inserted into bore 5 with its output, or base charge, end 8*a* close to the head-shaped section, 1*c*, and its input (actuation) end adjacent the butt-shaped section, 1*b*. Once the detonator is in place in bore 5, the user immediately recognizes the input and output ends of detonator 4 by the shape of sections 1*b* and 1*c*. Detonator 4 is seated against annular ledge 17 which projects into bore 5 at the end thereof adjacent cord-receiving section 1*c*.

In the detonator shown in FIG. 1, 8 is a tubular metal detonator shell integrally closed at one end 8*a* (the output end) and closed at the other end (the input end) by a rim-fired empty primed rifle cartridge casing 9, which is a metal shell having an open end and a primer charge 10 in contact with the rim of the inner surface of an integrally closed end. Casing 9 extends open end first into detonator shell 8 to dispose the outside surface 11 of the integrally closed end adjacent, and across, the end of detonator shell 8. Shell 8 contains, in sequence from end 8*a*, a base charge 12 of a detonating explosive composition; a priming charge 13 of a heat-sensitive detonating explosive composition; and a delay charge 14 of an exothermic-burning composition. Delay charge 14 is held in capsule 15, made of a polyolefin or polyfluorocarbon, having at one extremity a closure provided with an axial orifice therethrough, and having its other extremity 15*a* terminating and sandwiched between the walls of shell 8 and casing 9. Metal capsule 16 having one open extremity and a closure at the other extremity provided with an axial orifice therethrough is nested within capsule 15 with its closure resting against delay charge 14. Casing 9 is sealed within shell 8 by two circumferential crimps: 18 through shell 8, capsule 15, and casing 9; and 19 through shell 8 and casing 9 only. The length of detonator 4 is approximately equal to the length of tubular portion 1*a* of connector 1, and surface 11 of casing 9 is approximately coextensive with the end of tubular portion 1*a*.

A pair of matching oppositely disposed T-shaped apertures 20 and 21 extend transversely through sections 1*b* and 1*c*, respectively, each pair of apertures lying in planes which are parallel to the longitudinal axis of bore 5. The legs of T-shaped apertures 20 and 21 run parallel to the longitudinal axis of bore 5, apertures 20 having their head portions and apertures 21 their leg portions, nearest bore 5. The head portions of apertures 20 are wider (i.e., larger in dimension in a direction normal to the longitudinal axis of bore 5) than the head portions of apertures 21, and apertures 21 are longer than apertures 20 in the direction of the longitudinal axis of bore 5.

Tapered pin 22 is mateable with apertures 20, and tapered pin 23 with apertures 21. The pins are shown in their operating positions in FIG. 1 and in their as-molded positions in FIG. 2. The surface 22*a* of pin 22, which is the end surface of the leg of a T, is serrated. The surface 23*a* of pin 23, which is the top surface of the top of a T, is serrated. The serrated edges allow pins 22 and 23 to tightly engage the periphery of apertures 20 and 21, respectively. The remaining surfaces of the pins are smooth. Pins 22 and 23 are integrally connected to sections 1*b* and 1*c*, respectively, by thin flexible webs of plastic 24 and 25, respectively. This positioning of the webs permits pins 22 and 23 to be inserted into apertures 20 and 21, respectively, from either the top or bottom of the connector, positioned as shown in FIG. 1.

Section 1*b* of connector 1 has a groove or channel 27 which receives a U-shaped segment of LEDC 2. Section 1*c* has a groove or channel 28 which receives a U-shaped segment of LEDC 3. A U-shaped segment of a length of HEDC 26, e.g., Primacord®, is nested within the arms of U-shaped segment of LEDC 3, in side-by-side, apex-to-apex contact therewith, all four arms of cords 26 and 3 lying in substantially the same plane which contains the longitudinal axis of bore 5. Cords 2 and 3 may be, for example, the cord described in U.S. Pat. No. 4,232,606. Apertures 20 and 21 are positioned relative to the ends of tubular portion 1*a* and the positions of the U-shaped segments of cords 2, 3 and 26 so that the tapered pins pass between arms 2*a*, 3*a*, and 26*a* of the cords and wedge the apexes 2*b* and 3*b* of the U-shaped segments of cords 2 and 3 against the ends of detonator 4, and the apex 26*b* of the segment of cord 26 against apex 3*b*. The diameter of LEDC 3 is smaller than that of HEDC 26, and apex 3*b* is able to make contact with end 8*a* of detonator 4 by virtue of the wedging of the U-shaped segment of cord 3 into the aperture in annular ledge 17, which aperture is slightly larger than the diameter of cord 3. The wedging effect of pin 23 is accomplished with only a small portion of the pin length owing to the presence of the two cords 26 and 3.

The width of the head portions of apertures 20 is sufficient to provide a long enough apex 2*b* of cord 2 to assure reliable initiation of the primer charge 10 in the rim portion of casing 9. At the same time, apertures 21 are narrow enough to allow both cords 3 and 26 to bend in a U-shape with arms 3*a* and 26*a* in section 1*c* parallel to the longitudinal axis of shell 8.

In operation, the detonation of LEDC 2, whose side wall is in contact with the input end of detonator 4, causes the percussion-sensitive primer charge 10 to ignite, and in turn to initiate delay charge 14, priming charge 13, and base charge 12. Detonation of charge 12 causes LEDC 3 and HEDC 26 to detonate.

It will be seen that connector 1 can be used to hold a pair of receiver cords of different diameter, e.g., high- and low-energy detonating cords, adjacent the output end of detonator 4 only if the smaller-diameter cord, i.e., the LEDC, is positioned next to the detonator. If the positioning of cords 26 and 3 is reversed, pin 23 cannot be extended through apertures 21 because cord 26 cannot be wedged into the aperture in ledge 17. This is an advantage in field use in situations in which the LEDC must be placed closer to the detonator for proper functioning.

It will also be understood, however, that a single small-diameter cord, e.g., LEDC, a single large-diameter cord, e.g., Primacord® or E-Cord®, or a pair of nested small-diameter cords, e.g., two LEDC's, can also be held in position in connector 1 by varying the amount of extension of pin 23 through apertures 21. Also, a second small-diameter cord, e.g., LEDC, can be held in juxtaposed relationship to the nested small- and large-diameter cords shown in FIGS. 1 and 2.

Figure 5:
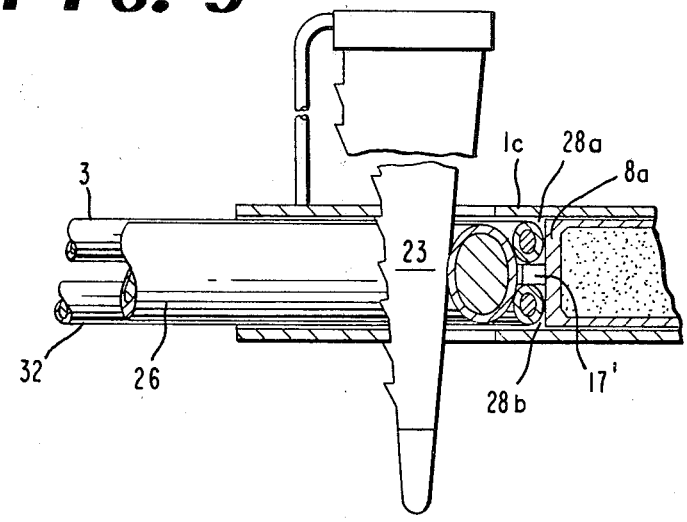
FIG. 5 is a cross-sectional view of a portion of the assembly shown in FIG. 1, except that three receiver cords instead of two are shown in propagation relationship with respect to the detonator, and cord aligner 17' is used in place of the annular ledge 17 in FIG. 1.

In another embodiment of the connector of this invention, shown in FIG. 5, the internal surface of section 1*c* is structured so as to permit two U-shaped segments of LEDC, 3 and 32, to be held in juxtaposed relationship in contact with the output end of the detonator. In this connector, the arms of one U-shaped segment are adapted to be in a different, parallel plane than the arms of the segment alongside it, the two planes being substantially parallel to a plane containing the longitudinal axis of bore 5. In this embodiment, for example, ledge 17 follows a path along the center of the inside wall of section 1*c*, forming two side-by-side channels 28*a* and 28*b* separated by ledge 17. One LEDC fits in each channel. The pair of LEDC's can be used alone or, as shown in FIG. 5, together with a nested single large-diameter cord, e.g., Primacord®, 26, which is wedged against the channelled LEDC's by pin 23. Also, each channel may be made deep enough to accommodate a pair of nested small-diameter cords, and these four cords can be used alone or together with a nested single large-diameter cord, which is wedged against the nearest pair of channelled LEDC's by pin 23. It may be seen that in this embodiment the Primacord® 26 could not be positioned next to the end 8*a* detonator 4 by virtue of the ledge 17 between the small-diameter channels 28*a* and 28*b*.

EXAMPLE

Cord lengths 2 and 3 were taken from the cord described in Example 1 of U.S. Pat. No. 4,232,606. They had a continuous solid core of a deformable bonded detonating explosive composition consisting of a mixture of 75% superfine PETN, 21% acetyl tributyl citrate, and 4% nitrocellulose prepared by the procedure described in U.S. Pat. No. 2,992,087. The superfine PETN was of the type which contained dispersed microholes prepared by the method described in U.S. Pat. No. 3,754,061, and had an average particle size of less than 15 microns, with all particles smaller than 44 microns. Core-reinforcing filaments derived from six 1000-denier strands of polyethylene terephthalate yarn were uniformly distributed on the periphery of the explosive core. The core and filaments were enclosed in a 0.9-mm-thick low-density polyethylene sheath. The diameter of the core was 0.8 mm, and the cord had an overall diameter of 2.5 mm. The PETN loading in the core was 0.53 g/m.

Detonator 4 had a Type 5052 aluminum alloy shell 8 which was 44.5 mm long and had an internal diameter of 6.5 mm and a wall thickness of 0.4 mm. Closed end 8*a* was 0.1 mm thick. Plastic capsule 15, made of high-density polyethylene, was 21.6 mm long, and had an outer diameter of 6.5 mm and an internal diameter of 5.6 mm. The axial orifice in capsule 15 was 1.3 mm in diameter. Capsule 16, made of Type 5052 aluminum alloy, was 11.9 mm long, and had an outer diameter of 5.6 mm and a wall thickness of 0.5 mm. The axial orifice in capsule 16 was 2.8 mm in diameter. Base charge 12 consisted of 0.51 gram of PETN, which had been placed in shell 8 and pressed therein at 1300 Newtons with a pointed press pin. Priming charge 13 was 0.17 gram of lead azide. Capsule 15 was placed next to charge 13 and pressed at 1300 Newtons with an axially tipped pin shaped to prevent the entrance of charge 13 into capsule 15 through the axial orifice therein. Delay charge 14, which was loosely loaded into capsule 15, was a 2.5/97.5/20 (parts by weight) mixture of boron, red lead, and silicon. Capsule 16 was seated in capsule 15 at 1300 Newtons. Shell 9 and charge 10 constituted a 0.22-caliber rim-fired empty primed rifle cartridge casing.

The connector 1 was made of high-density polyethylene in the configuration shown in FIG. 2. It had an overall length of about 8.6 cm, a wall thickness of about 3.2 mm, and a bore 5 of about the same diameter and length as the detonator. T-shaped aperture 20 was spaced 4.8 mm from tubular portion 1*a* (measured from the center of the T on its longitudinal axis), the overall length of the T being 10.4 mm and the length of the top of the T being 7.9 mm. T-shaped aperture 21 extended substantially to tubular portion 1*a*, having an overall length of 12.7 mm and a length of the top of the T of 5.1 mm. The aperture in ledge 17 was 4.6 mm long and 3.1 mm wide. Channels 27 and 28 were 0.76 mm deep and 3.1 mm wide. Pin 23 was 57.7 mm long and had a 5° angle of taper. Pin 22 was 40.1 mm long and had a 5° angle of taper.

The detonator was inserted into the connector with its output end seated against ledge 17. Then the cords were folded back to form U-shaped loops, which were inserted into the cord-receiving sections until the apexes 2*b* and 3*b* abutted the ends of the detonator. Pins 22 and 23 were then inserted through apertures 20 and 21, respectively, passing between the arms of the U-shaped cord segments to hold apexes 2*b* and 3*b* against the ends of the detonator. In this instance, because cord 26 was absent, pin 23 was more fully extended through aperture 21.

Initiation of cord 2 by means of an end-abutted No. 8 electric blasting cap caused the detonation of cord 3 after a delay of 17 ms.

In another example, a length of E-cord® was placed in contact with cord 3 as shown in FIGS. 1 and 2. E-Cord® has a core of granular PETN, in a loading of 5.3 grams per meter, encased in textile braid, a plastic jacket, and cross-countered textile yarns. Detonation of cord 2 actuated detonator 4, which in turn caused the detonation of cords 3 and 26.

In another example, cord 3 was replaced by cord 26, which abutted ledge 17 without contacting end 8*a* of detonator 8. Detonation of cord 2 actuated detonator 4, which in turn caused the detonation of cord 26.

Figure 3:
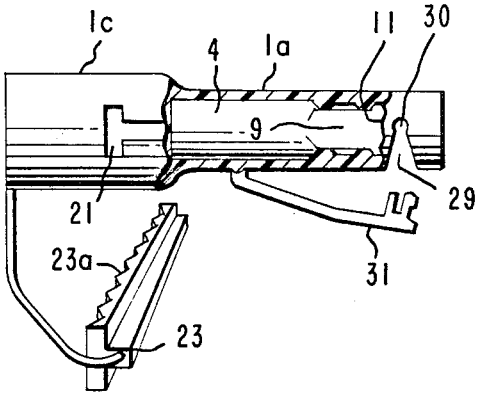
FIG. 3 is a plan view in partial cross-section of a connector for holding a substantially straight segment of donor cord and a substantially U-shaped segment of a receiver cord adjacent the ends of a detonator.
Figure 4:
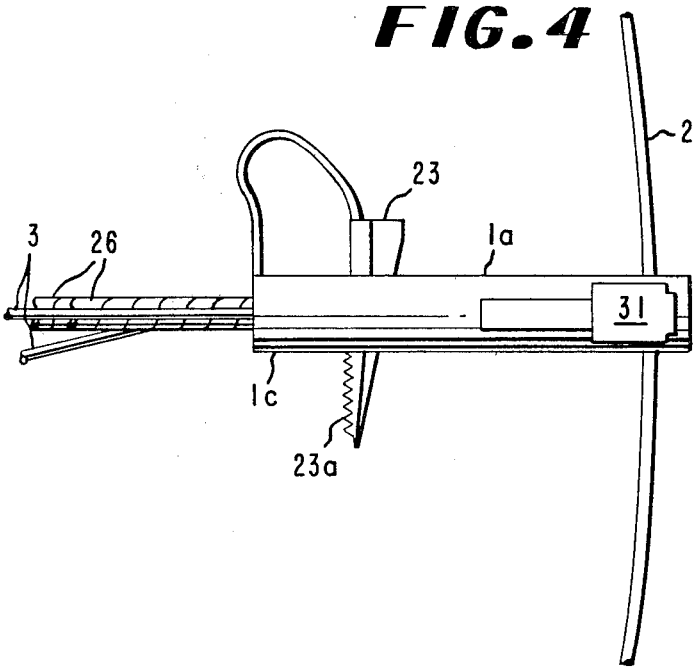
FIG. 4 is a side view of the connector shown in FIG. 3 assembled with one donor and two receiver cords.

The connector shown in FIGS. 3 and 4 has a tubular portion 1*a* whose bore receives detonator 4. Receiver-cord-housing section 1*c* at one end of tubular portion 1*a* communicates with the bore thereof and internally receives a U-shaped segment of LEDC 3 and a U-shaped segment of high-energy detonating cord 26 nested within the arms of cord 3. As in the connector shown in FIGS. 1 and 2, apertures 21 are mateable with T-shaped tapered pin 23 having a serrated edge 23*a*. Pin 23 holds the apex of the U adjacent the output end of detonator 4 (shown in FIG. 1). At its opposite end, tubular portion 1*a* has a transverse slot 29 which communicates with the bore in tubular portion 1*a*. Slot 29 has a recessed channel 30 which engages a length of LEDC 2 in a recessed position substantially perpendicular to the longitudinal axis of tubular portion 1*a* and adjacent the outside end surface 11 of primer shell 9. Slotted locking means 31 forms a closure with slot 29 to lock cord 2 in place.

The low-energy detonating cords used in the present assembly are cords having a core of explosive in a loading of about from 0.2 to 2 grams per meter of length surrounded by protective sheathing material(s). Typical of such cords are those described in the aforementioned U.S. Pat. No. 4,232,606 and in U.S. Pat. No. 3,125,024, the disclosures of which are incorporated herein by reference. The donor LEDC must produce sufficient side-output energy that its percussive force initiates the primer charge at the adjacent outside end surface of the primer shell (the input end of the detonator), e.g., a 0.02-gram primer charge in an empty primed 0.22 caliber rifle cartridge casing. At the same time, however, the side-output of the donor LEDC should not be so great as to rupture the adjacent primer shell and vent the detonator, which can cause a decrease in the burning rate of the delay composition in delay detonators. Suitable donor cords are, for example, the cord described in U.S. Pat. No. 4,232,606 in an outer diameter of 0.25 cm and explosive core diameters of 0.08 cm and 0.13 cm, and explosive loadings of 0.53 g/m and 1.6 g/m, respectively; and the cord described in U.S. Pat. No. 3,125,024 in loadings of 0.85 to 1.06 g/m. The cord having the 0.53 g/m explosive loading is a preferred donor LEDC (trunkline) because of the low amount of noise produced when it detonates. To assure more reliable initiation of the primer charge, cords of lower core explosive loading, e.g., a 0.4 g/m cord, require more intimate contact with the outside end surface of the primer shell than do cords of higher core explosive loading, e.g., a 1.6 g/m cord. However, the possibly deleterious effect of a gap, e.g., of 0.8–1.6 mm, between a cord of lower loading and the surface of the primer shell can be overcome by looping the donor cord so that two portions of the cord are adjacent to the primer shell surface, either side-by-side or one atop the other. Thus, in assemblies wherein two substantially U-shaped segments of donor LEDC are held in the donor-cord-housing section of the connector in juxtaposed (side-by-side) position or nested one within the other, the two segments can be segments of the same length of cord, or of two different lengths of cord.

When used with a delay detonator, heavier cords, e.g., the 1.6 g/m cord, may have to be spaced from the primer shell surface, e.g., by a distance of about 3.2 mm, to prevent puncturing of the surface and venting of the detonator.

The donor cord can be arrayed substantially perpendicular to the longitudinal axis of the detonator, as is shown in FIG. 4, or the segment of cord adjacent to the primer shell can be the apex of a U-shaped segment of cord with the arms of the U extending away from the detonator in an oblique direction or in a direction substantially parallel to the longitudinal axis of the detonator shell.

In the case of the receiver cord(s), the segment of cord adjacent the output end of the detonator is the apex portion of a U-shaped segment of cord held in a manner such that the two arms of the U held in the connector extend away from the detonator in a direction substantially parallel to the longitudinal axis of the detonator shell. It has been found that even the relatively insensitive cord of U.S. Pat. No. 4,232,606, which heretofore, when initiated by a detonator, had its exposed end coaxially abutting the end of the detonator, can be initiated reliably through its sidewall by an adjacent detonator provided that the cord, bent in the shape of a U, is arrayed with the substantially parallel arms of the U directed away from the detonator, and the apex section of the U adjacent the output end of the detonator. This receiver cord configuration results in greater reliability of cord initiation, especially with smaller base charge loads and in a wet environment. The parallel relationship of the arms of the U relative to the detonator refers to the segment of cord within the connector. Beyond the confines of the connector, the cords need not, and usually will not, remain parallel.

The beneficial effect of the U-shaped receiver cord configuration on reliability of initiation is shown by the following experiments:

Aluminum shells 28.2 mm in length and having an 0.08-mm-thick bottom were loaded with 0.52 gram of cap-grade PETN and pressed at 1300 Newtons with a pointed pin, and 0.13 gram of lead azide pressed at 1300 Newtons. 0.22-Caliber rim-fired primers were inserted into the shells and crimped. The 0.53 g/m cord described in the foregoing examples was positioned in contact with the base-charge end of the detonators.

In one group of experiments, the receiver cord was taped transversely to the end of the detonator, so as to form a T therewith. The receiver cord detonated in both directions in 50% of the assemblies. In another group of experiments, the receiver cord was bent into a U-shaped configuration and taped to the detonator with the apex of the U in contact with the end of the detonator and both arms of the U extending away from the detonator in a direction parallel to the detonator's longitudinal axis. Both arms detonated in 80% of the assemblies. Both arms detonated in 100% of the assemblies when a pin was positioned between the arms of the U at the apex.

In the assembly of the invention, the LEDC receiver adjacent the detonator may be any plastic- or textile-sheathed LEDC, e.g., one of the cords described above for the donor cord, or the cord described in U.S. Pat. No. 3,590,739. In one embodiment of the invention, one or more secondary cords, e.g., a high-energy detonating cord such as Primacord® or E-Cord®, may be initiated at the same time as the LEDC receiver cord by placing a U-shaped segment thereof adjacent the U-shaped segment of LEDC receiver cord as was described above. Preferably, at least one of the receiver cords is in intimate contact with the base-charge end of the detonator, but a gap of up to about 6.350 mm between the detonator shell and the receiver cord is tolerable, particularly with receiver cords whose explosive loading is at the upper end of the LEDC range. The presence of the secondary cord(s) adjacent the receiver cord is useful, for example, when a trunkline and one or more downlines are to be initiated by the detonator.

In order for a detonation to be transmitted from the donor LEDC to the receiver, the cords are joined in detonation-propagating relationship by a percussion-actuated detonator in which the detonator shell is closed at its input end by a metal primer shell which contains a small primer charge of a percussion-sensitive material adjacent an integrally closed end. The partially empty primer shell extends open end first into the detonator shell so that the outside surface of the primer charge end is exposed, and is adjacent, and across, the end of the detonator shell. A readily available, and therefore preferred, primer shell is an empty center- or rim-fired primed rifle cartridge casing, for example for 0.22 caliber short ammunition. Such primer shells usually contain about 0.015 gram of percussion-sensitive material. As is customary, the detonator shell contains, in sequence from its integrally closed end, (1) a base charge of a detonating explosive composition, e.g., pentaerythritol tetranitrate (PETN), and (2) a priming charge of a heat-sensitive detonating composition, e.g., lead azide. To assure the initiation of the LEDC receiver, the base charge should amount to about from 0.2 to 1.0 gram of powder pressed at 890 to 1550 Newtons. Base charges at the lower end of this range should be pressed at pressures at the upper end of the range. A preferred base charge is 0.5±0.03 gram pressed at 1246±89 Newtons. In a delay detonator, a delay charge of an exothermic-burning composition, e.g., a boron/red lead mixture, is present in the sequence after the priming charge.

Preferably, the integrally closed (output) end of the detonator, e.g., 8*a* in FIG. 1, is 0.08 mm to 0.25 mm thick. However, due to limitations imposed by manufacturing and handling conditions, usually the thickness will be at least 0.13 mm. Aluminum and bronze shells having output ends as thick as 0.76 mm and 0.51 mm, respectively, usually will require a 0.80 gram base charge to reliably initiate the LEDC described in U.S. Pat. No. 4,232,606 in the present assembly. A smaller base charge, e.g., 0.65 gram, may be acceptable with the thicker shell ends if the ends are provided with a concavity.

A preferred delay detonator has a polyolefin or polyfluorocarbon carrier capsule or tube for the delay charge, as is described in co-pending U.S. application Ser. No. 77,718, filed Sept. 21, 1979, now U.S. Pat. No. 4,369,708. This plastic carrier for the delay charge has a beneficial effect on delay timing inasmuch as it reduces the variability of the timing with changes in the surrounding temperature or medium (e.g., air vs. water). It also provides a better fit between the delay carrier and metal shell (and therefore a better seal for the priming charge) and eliminates the friction-related hazards associated with the fitting of a metal delay carrier into a metal detonator shell over a priming explosive charge. A carrier capsule has one open extremity and a closure at the other extremity provided with an axial orifice therethrough, the closure on the capsule being adjacent the priming charge.

A plastic tube or capsule adjacent the priming charge is preferred both in delay and instantaneous detonators because the wall of the tube or capsule can be made to terminate and be sandwiched between the walls of the detonator shell and the primer shell, affording an improved seal when a circumferential crimp is made which jointly deforms the walls of the detonator shell, the plastic tube or capsule, and the primer shell. In this embodiment, the wall portion of the primer shell adjacent its closed end remains in contact with the wall of the detonator shell to provide an electrical path between the shells.

The connectors shown in FIGS. 1 through 5 are preferred means of holding the donor and receiver cords adjacent the ends of the detonator. Other connectors can be used, however. For example, a metal sleeve which extends partially or totally around the detonator shell, may be provided with cord-engaging transverse slots at or near each end, the segment(s) of cord being maintained in a U-configuration by the metal sleeve itself or by a suitable cord-clasping means outside the sleeve. Also, it will be understood that the connector of the invention need not be a single integral article, but may advantageously be formed of two or more parts or sections, e.g., sections formed by separating central tubular portion 1*a* into two parts. This allows the use of the connector with detonators of different length, the different portions meeting, or being separated so that some of the detonator shell is exposed.

I claim:

1. A non-electric blasting assembly comprising:

(a) first and second lengths of low-energy detonating cord (LEDC) having an explosive core loading of about from 0.2 to 2 grams per meter of length;

(b) a precussion-actuated detonator comprising a tubular metal detonator shell integrally closed at an output end and closed at its other, input end by a partially empty, shorter tubular metal primer shell having an open end and supporting a percussion-sensitive primer charge adjacent the inside surface of an integrally closed end, said primer shell extending open end first into said detonator shell to dispose the outside surface of its primer charge end adjacent, and across, the end of said detonator shell, said detonator shell containing, in sequence from its integrally closed end, (1) a base charge of a detonating explosive composition and (2) a priming charge of a heat-sensitive detonating explosive composition;

(c) means for holding said first length of cord with a portion of its side adjacent the outside end surface of said primer shell, and for holding the apex of a substantially U-shaped segment of said second length of cord adjacent the integrally closed end of said detonator shell in a manner such that the two arms of the U extend away from said detonator in a direction substantially parallel to the longitudinal axis of said detonator shell; and (d) means on said holding means for identifying the input and output ends of the detonator held thereby.

2. A blasting assembly of claim 1 wherein a substantially U-shaped segment of a high-energy detonating cord is held within the arms of said substantially U-shaped segment of said second length of LEDC.

3. A blasting assembly of claim 1 wherein said holding means comprises a tubular portion whose bore receives said detonator; a first cord-housing section at one end of said tubular portion and communicating with its bore, said first cord-housing section housing a substantially U-shaped segment of said second length of LEDC with the two arms of the U lying in substantially the same plane as the longitudinal axis of the bore and the apex of the U positioned adjacent the end of the bore, and having a pair of oppositely disposed apertures on an axis which is substantially perpendicular to said plane; a tapered pin mateable with said pair of aperture and extending through the apertures and between the arms of the substantially U-shaped segment of cord, holding the apex of the U adjacent the output end of said detonator; a second cord-housing section in said tubular portion at the opposite end thereof comprising a transverse slot communicating with said bore and engaging said first length of LEDC in a recessed position in said tubular portion substantially perpendicular to the longitudinal axis of said tubular portion and adjacent the outside end surface of said primer shell, said tubular portion having locking means adjacent said transverse slot for preventing the disengagement of said first length of cord therefrom.

4. A blasting assembly of claim 1 wherein the apex of a substantially U-shaped segment of a third length of LEDC is held adjacent the integrally closed end of said detonator shell in a manner such that the arms of the two U-shaped LEDC segments adjacent said end extend away from said detonator in a direction substantially parallel to the longitudinal axis of said detonator shell.

5. A blasting assembly of claim 4 wherein a substantially U-shaped segment of a high-energy detonating cord is held within the arms of said substantially U-shaped segments of said second and third lengths of LEDC.

6. A blasting assembly of claim 1 wherein said base charge of a detonating explosive composition is a pressed powder in the amount of at least about 0.2 gram.

7. A blasting assembly of claim 6 wherein said detonating explosive composition in said base charge is pentaerythritol tetranitrate.

8. A blasting assembly of claim 1 wherein said lengths of low-energy detonating cord comprise a continuous solid core of a deformable bonded detonating explosive composition comprising a crystalline high explosive compound selected from the group consisting of organic polynitrates and polynitramines admixed with a binding agent, the particles of crystalline high explosive compound in said composition having their maximum dimension in the range of about from 0.1 to 50 microns; and, surrounding said explosive core, protective sheathing comprising one or more layers of plastic material.

9. A blasting assembly of claim 8 wherein the diameter and the explosive content of said core provide about from 0.5 to 1.6 grams of crystalline high explosive compound per meter of length of said cord.

10. A blasting assembly of claim 1 wherein the side portion of said first length of cord adjacent the outside end surface of said primer shell is the apex of a U in a substantially U-shaped segment, the two arms of the U extending away from said detonator in a direction substantially parallel to the longitudinal axis of said detonator shell.

11. A blasting assembly of claim 10 wherein said holding means comprises a central tubular portion whose bore receives said detonator; a cord-housing section at each end of said tubular portion and communicating with its bore, each such section housing a substantially U-shaped segment of said low-energy detonating cord with the two arms of the U lying in substantially the same plane as the longitudinal axis of the bore and the apex of the U positioned adjacent the end of the bore, and having a pair of oppositely disposed apertures on an axis which is substantially perpendicular to said plane; and two tapered pins, one mateable with each pair of apertures and extending through the apertures and between the arms of the substantially U-shaped segment of cord, holding the apex of the U adjacent the end of said detonator.

12. A blasting assembly of claim 11 wherein the tapered pin mateable with the pair of apertures in the cord-housing section which receives said substantially U-shaped segment of said second length of LEDC extends between the arms of a substantially U-shaped segment of a high-energy detonating cord within the arms of said segment of said second length of LEDC.

13. A blasting assembly of claim 11 wherein said holding means is a one-piece connector made of molded plastic, each tapered pin being attached to the cord-housing section with which it cooperates by a thin flexible web of plastic, and one of said cord-housing sections has the shape of the head, and the other the butt, of an arrow, the output end of said detonator being adjacent the head-shaped cord-housing section and the input end adjacent the butt-shaped cord-housing section of said connector.

14. A blasting assembly of claim 13 wherein said primer shell is a rim-fired empty primed rifle cartridge casing, and the pair of oppositely disposed apertures in the butt-shaped section are sufficiently large-dimensioned in a direction normal to the longitudinal axis of said detonator that the apex of the U contacts the rim portion of the outside end surface of the cartridge casing.

15. A connector for holding donor and receiver detonating cords in propagating relationship to a detonator comprising:

(a) a central tubular portion whose bore is adapted to receive a detonator having a percussion-responsive input end and a base-charge output end;

(b) first and second cord-housing sections at the ends of said tubular portion and communicating with the bore thereof, said first section being adapted to house a substantially U-shaped segment of donor LEDC with the two arms of the U lying in a plane which is parallel to, or substantially coincident with, a plane containing the longitudinal axis of said bore,and the apex of the U positioned adjacent the end of said bore, and said second section being adapted to house a substantially U-shaped segment of a receiver detonating cord with the two arms of the U lying in a plane which is parallel to, or substantially coincident with, a plane containing the longitudinal axis of said bore, and the apex of the U being positioned adjacent the end of said bore, said first and second cord-housing sections each having a pair of matching oppositely disposed apertures on an axis which is substantially perpendicular to said planes; and (c) two tapered pins, one mateable with each pair of apertures and adapted to extend through said apertures and between the arms of said substantially U-shaped segment of cord, and to hold the apex of the U adjacent the end of said detonator, the apex of the substantially U-shaped segment of donor LEDC adapted to be housed in said first cord-housing section being adapted to be held adjacent the input end of said detonator, and the apex of the substantially U-shaped segment of receiver detonating cord adapted to be housed in said second cord-housing section being adapted to be held adjacent the output end of said detonator.

16. A connector of claim 15 wherein said second cord-housing section has the shape of the head, and said first cord-housing section has the shape of the butt, of an arrow.

17. A connector of claim 15 wherein said receiver detonating cord adapted to be housed in said second section is HEDC.

18. A connector of claim 15 wherein said receiver detonating cord adapted to be housed in said second section is LEDC.

19. A connector of claim 18 wherein a substantially U-shaped segment of HEDC is adapted to be held within the arms of said substantially U-shaped segment of LEDC adapted to be housed in said second section, the internal surface of said connector being so configured that only an LEDC segment is adapted to be held adjacent the output end of said detonator.

20. A connector of claim 19 wherein the tapered pin mateable with said pair of apertures in said second cord-housing section is adapted to extend between the arms of substantially U-shaped cord segments of LEDC and HEDC only when a U-shaped segment of LEDC has its apex adjacent the output end of said detonator.

21. A connector of claim 19 wherein the internal surface thereof which is so configured is the internal surface of said second cord-housing section and/or the internal surface of said central tubular portion adjacent thereto.

22. A connector of claim 19 wherein the pair of apertures in said second cord-housing section is longer in the direction of the bore's longitudinal axis than the pair of apertures in said first cord-housing section, and the tapered pin mateable with the pair of apertures in said second section is longer than the pin mateable with the pair of apertures in said first section whereby larger cord diameters can be accommodated between the pin and the end of the detonator, the degree of extension of the pin through the pair of apertures being greater with smaller-diameter cords.

23. A connector of claim 22 wherein each of said tapered pins is provided with a serrated surface adapted to engage an edge of the pair of apertures mateable therewith.

24. A connector of claim 19 wherein said cord-housing sections are provided with channels for receiving and seating substantially U-shaped segments of LEDC, and said central tubular portion or said second cord-housing section has a ledge member against which the output end of the detonator is adapted to rest and be contacted by the apex of a U-shaped segment of LEDC.

25. A connector of claim 24 wherein the degree of taper of the tapered pin mateable with the pair of apertures in said second cord-housing section and the location and length of said apertures in the direction of the bore's longitudinal axis are such that said pin, at different levels of extension through said apertures, is adapted to (a) wedge a single U-shaped segment of LEDC against the end of the detonator; (b) wedge a single U-shaped segment of HEDC against said ledge member; and (c) wedge a pair of nested U-shaped segments of LEDC or of LEDC and HEDC between said pin and the end of said detonator when said segment of LEDC is seated in said channel and in contact with the end of said detonator.

26. A connector of claim 18 wherein said substantially U-shaped segment of LEDC adapted to be housed in said second section is the first of a pair of juxtaposed substantially U-shaped LEDC segments adapted to be housed therein with the arms of each U of said pair of segments lying in a plane which is parallel to a plane containing the longitudinal axis of said bore, and the apex of the U in each of said pair of segments positioned adjacent the end of said bore, the pin mateable with the pair of apertures in said second cord-housing section being adapted to extend between the arms of the juxtaposed U-shaped LEDC segments and to hold the apex of the U's adjacent the output end of the detonator.

27. A connector of claim 26 wherein a substantially U-shaped segment of HEDC is adapted to be held within the arms of said pair of juxtaposed substantially U-shaped LEDC segments adapted to be housed in said second section, the internal surface of said connector being so configured that only the pair of LEDC segments is adapted to be held against the output end of said detonator.

28. A connector of claim 27 wherein the internal surface thereof which is so configured is the internal surface of said second cord-housing section and/or the internal surface of said central tubular portion adjacent thereto.

29. A connector of claim 27 wherein the tapered pin mateable with said pair of apertures in and second cord-housing section is adapted to extend between the arms of said pair of juxtaposed substantially U-shaped LEDC segments and the arms of said substantially U-shaped segment of HEDC only when the U-shaped LEDC segments have their apexes adjacent the output end of said detonator.

* * * * *